US006657404B1

(12) United States Patent
Clark et al.

(10) Patent No.: US 6,657,404 B1
(45) Date of Patent: Dec. 2, 2003

(54) METHOD AND APPARATUS FOR POWER CONTROL

(76) Inventors: Howard G. Clark, 5032 N. Valadez St., Las Vegas, NV (US) 89149; Larry L. Kinder, 8805 Bayside Cir., Las Vegas, NV (US) 89117

( * ) Notice: Subject to any disclaimer, the term of this patent is extended or adjusted under 35 U.S.C. 154(b) by 0 days.

(21) Appl. No.: 10/165,365

(22) Filed: Jun. 7, 2002

(51) Int. Cl.[7] ..... G05F 1/00

(52) U.S. Cl. ..... 315/294; 315/282; 315/287; 315/239; 315/226; 315/DIG. 5

(58) Field of Search ..... 315/212, 216, 315/226, 232, 240, 239, 287, 282, 291, 294, 312, 320, DIG. 5

(56) References Cited

U.S. PATENT DOCUMENTS 4,728,866 A * 3/1988 Capewell et al. ..... 315/224
4,956,583 A * 9/1990 Lawrence et al. ..... 315/220
5,434,478 A * 7/1995 Kovalsky et al. ..... 315/209 R

* cited by examiner

*Primary Examiner*—Halssa Philogene
(74) *Attorney, Agent, or Firm*—Weide & Miller, Ltd.

(57) ABSTRACT

A method and apparatus is disclosed to reduce power consumption of a load. In one embodiment a power control system selectively routes power directly to a load or to a power reduction device. A delay may occur prior to introduction of the power reduction device to fully energize the load. The power reduction device may operate in conjunction with signal modification device. The signal modification device modifies the signal provided to the load to achieve desired operation of the load. In one embodiment the power reduction device comprises a step-down transformer and the signal modification device comprises a capacitor. In one embodiment the power reduction device is selected to remove unwanted frequency components from the signal provide to the load. In various other embodiments the power control system may be configured to stagger start the load to minimize the peak draw of the load.

20 Claims, 6 Drawing Sheets

METHOD AND APPARATUS FOR POWER CONTROL

FIELD OF THE INVENTION

The present invention relates to lighting control systems and in particular to a lighting control method and apparatus to reduce power consumption of lighting systems.

BACKGROUND OF THE INVENTION

As can be understood, there are numerous reasons to reduce power consumption of a lighting or other electrical system. The benefits include reduced power costs to the user and benefits to the environment. While it may be desirable to reduce an electrical system's power consumption, it is preferred to not reduce or hinder operation of the electrical system. By way of example, a lighting system's power consumption may be reduced by dimming the lights, but this may undesirably reduce the light output of the lighting system. The lighting system was likely installed and designed for a predetermined amount of input power or voltage and hence reducing the amount of the voltage defeats the purpose of the lighting systems.

It is known however that certain types of electrical systems may be provided less power without hindering operation. In the case of lighting systems, it is known in the prior art that high intensity discharge (HID) and flourescent lighting systems may be operated at a lower voltage after operation for a short time at full power. Power savings through dimming may be realized without appreciable amount of reduced light output. For example, the change in light output can not be detected by the human eye.

In systems of the prior art a transformer is utilized to modify the voltage. As is understood, a transformer is capable of modifying a signal's voltage level. Through a reduction in voltage supplied to the lights, power saving may be realized. In systems of the prior art, one or more transformers are utilized to step up the voltage to a level suitable for driving the high power HID or flourescent lighting systems. After a short period of time, the transformer operation may be modified or the signal directed to an additional transformer to step-down the voltage. Stepping down the voltage through one or more additional transformer devices reduces the voltage to thereby allow a savings in power consumption.

While it is desirable to reduce power consumption in lighting or other electrical systems by reducing the voltage supplied to these systems reliable and dependable, operation must be maintained. In one example installation, HID and flourescent lighting may be installed in a parking lot, parking garage, or building interior. If the power saving systems malfunctions, the lights may be rendered inoperable. This could create an undesirable and dangerous environment. In other instances, the lights may facilitate business transactions. If the lighting system illuminates an automobile parking lot or the interior of a business establishment, an inoperable lighting system could result in lost profits and a reduction in market share. Customer goodwill and reputation may also be damaged.

As a drawback to prior art systems, the combination of running the lamps at voltage levels near the minimum voltage level for continued operation and use of the voltage modifying devices, such as a transformer, may create unreliable operation. In some instances unwanted signal components are introduced into the power signal which disrupt operation. In the case of power reduction system configured with transformers, signal components may be introduced that disrupt desired operation. In some instances the unreliableness may be so severe as to cause the lamps to extinguish. For the above stated reasons, this is very undesirable and makes such systems unusable.

The present invention identifies the source of the problem in prior art systems and provides an inexpensive, reliable, and safe solution to the drawbacks of the prior art.

SUMMARY OF THE INVENTION

The invention described herein overcomes the drawbacks of the prior art by providing an efficient, low cost, and reliable method and apparatus to reduce power consumption. To accommodate the characteristics of certain types of loads, the method and apparatus described herein provides full power to the load for a first period of time. During this first period of time the load reaches full operating power and may thereafter be operated at a reduced power level without noticeable change in output of the load. Accordingly, during a second time period a reduced amount of power is provided to the load without an appreciable change in performance by the load. As a result the load consumes less power.

During the second period when the load is operating at a reduces power level, it is desired to provide a power signal, sufficient voltage, or sufficient current so that the load does not receive less power than is necessary to maintain desired operation. In one embodiment a signal filtering system is located to filter or clean the power signal, voltage, or current provided to the load. As a result, the conjunction with the power signal, voltage, or current that is provided to the load is of a nature sufficient to maintained operation of the load.

In one embodiment a power control system is provided that is configured to control the amount of power provided to a load. The system may comprise a timer configured to generate one or more control signals and a step-down transformer having an input node and an output node such that the output node is connected to the load. Also included is a switching system configured to selectively provide, responsive to the one or more control signals, power directly to the load or to the input of the step-down transformer. To filter or otherwise clean the signal, a capacitor connected to the output node such that unwanted signal harmonics at the output node are not provided to the load. In this embodiment the switching system provides power to the step-down transformer instead of directly to the load thereby reducing the amount of power provided to the load. The term harmonic as used herein is defined to mean any unwanted signal component. This includes unwanted signal components, such as a third harmonic, generated by a transformer.

In variations to this embodiment, the one or more control signals generated by the timer cause the switching system to provide power directly to the load during a first period and to the step-down transformer during a second period, wherein the second period is subsequent to the first period. It contemplated that the capacitor comprises a capacitor selected to provide the third harmonic to a ground node. The switching system may comprises one or more relays and the load may comprise lamps selected from the group consisting of metal halide lamps, high pressure sodium lamps, and mercury vapor lamps.

In another embodiment, the system for reducing the amount of power consumed by a lighting system comprises an input configured to connect to a source of power and a controller configured to generate one or more control signals. Also provided is a voltage control system configured to reduce the amount of voltage provided to the lighting system and a filter configured to filter unwanted signal components from the voltage provided to the lighting system. Further provided is one or more relays, responsive to the one or more control signals, configured to selectively activate the voltage control system to thereby reduce the amount of voltage provided to the lighting system such that the controller does not activate the voltage control system until after the lighting system operates at full power for a time sufficient to sustain operation at the reduced amount of voltage. In one embodiment, the voltage control system comprises a transformer. The system may further include a timer or a sensor configured to control activation of the system.

A method may be enabled for controlling the power provided to a load to reduce power consumption of the load. One embodiment includes the steps of, which may be executed in various order, closing a load relay to provide power to a load and closing a transformer relay to provide power to a step-down transformer. The step-down transformer includes a stepped down output that is connected to a step down relay, wherein the step down relay also connects to a first node. The first node serves as a connection point for the load and a capacitor and the capacitor is selected to shunt unwanted signal components to ground. Next, the method includes opening the load relay while closing the step down relay so that the step down relay selectively controls power flow from the stepped down output to the first node and wherein opening the load relay and the closing the step down relay occurs after the step-down transformer and load have reached full operating capacity. The load may comprise a plurality of lamps and the capacitor may be selected to conduct harmonics created by the step-down transformer away from the load. In one embodiment the unwanted signal components comprise signal components having frequencies at or above the third harmonic.

In another embodiment the invention comprises a method for reducing power consumption of a lighting system. The method comprises the steps of providing a signal at a first voltage to the lighting system during a start-up period and thereafter activating a voltage reduction module. The voltage reduction module creates a signal having a second voltage, wherein the second voltage is smaller than the first voltage. Next, processing the signal having a second voltage to remove unwanted frequency components of the signal having a second voltage and thereafter providing the signal having a second voltage to the load after the start-up period.

In this method the start-up period may comprise a period of time during which the lighting system operates at full power. In one embodiment the lighting system comprises lamps selected from the group consisting of metal halide lamps, high pressure sodium lamps, and mercury vapor lamps. The step of processing may comprise providing the signal to a node to which a capacitor is connected to thereby remove signal harmonics. It is contemplated that in one embodiment the signal at the first voltage may comprise a signal at a voltage selected from the group of 120, 208, 277, 240, and 480 volts.

Additional details and variations of the invention are described in more detail below. It is contemplated that the features and elements may be described in combination or alone.

DETAILED DESCRIPTION OF THE INVENTION

A method and apparatus for controlling power distribution to a load is disclosed. In the embodiment described herein the load comprises a light or lighting system. It is contemplated that the method and apparatus for control power described herein may control any type load including but not limited to lighting systems high intensity discharge, low pressure sodium, fluorescent, iridescent, metal halide, mercury vapor, high pressure sodium lighting systems. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
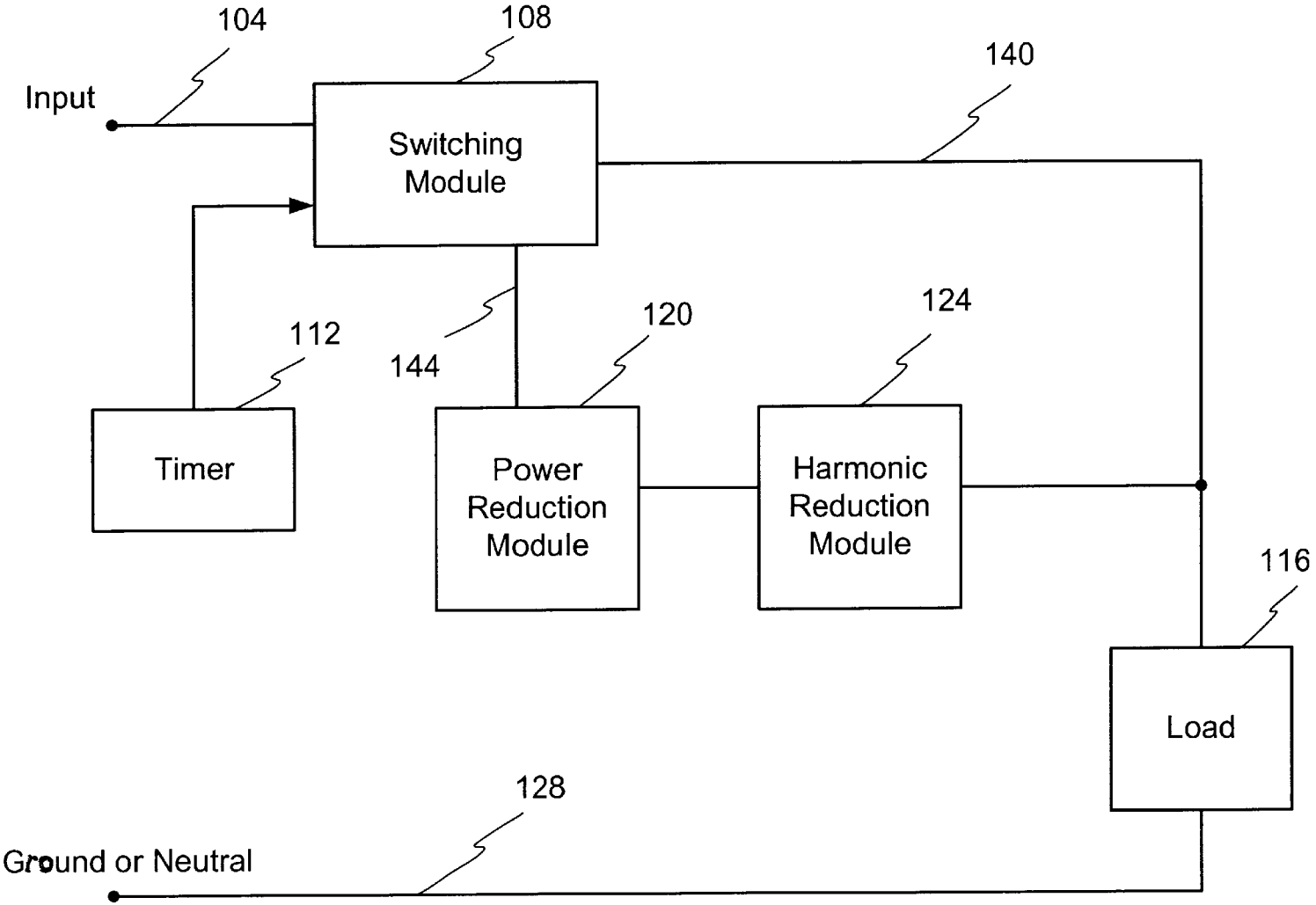
FIG. 1 illustrates a block diagram of an example embodiment of power control system as contemplated by the invention.

FIG. 1 illustrates a block diagram of an example embodiment of power control system as contemplated by the invention. One exemplary use of the power control system as shown in FIG. 1 is to reduce power consumption of a load, such as a lamp or lighting system. As shown in FIG. 1, in an input 104 connects to a switching module 108. The switching module 108 also receives input from a timer 112 or other control device. The switching module 108 connects to a load 116 and to a power reduction module 120. The power reduction module 120 connects to a harmonic reduction module 124 which in turn connects to the load 116. The opposing side of the load 116 connects to a ground or neutral 128. It is contemplated that the system of FIG. 1 may be configured in single phase or three phase. In a three phase environment two additional inputs (shown in FIG. 5) with additional devices 108, 112, 120, 124 would be connected in a similar fashion to service other loads.

Each element shown in FIG. 1 is now discussed in more detail. The switching module 108 comprises any type of device configured to switch power output between conductors 140 and 144. In various embodiments the switching module 108 comprises a relay, switch, voltage or current controlled switch, contacts, resistors, capacitors, or any other type of switching system. It is contemplated that the switching of the power or signal in the input 104 may occur instantaneously or close thereto, concurrently, or as part of a progressive fade in transfer of the output between conductors 140 and 144. Hence, for a period both conductors 140, 144 may be energized. The timer 112 or other control device, which connects to the switching module 108, is configured to control the time at which the switching module 108 switches/toggles and the rate at which switching occurs. The timer 112 may operate based on time of day, light monitoring systems, or other factors.

As discussed above, the load 116 may comprise any type of load that would benefit from the power saving aspects described herein. In one embodiment the load comprises a lamp, lamp fixture, or lighting system. To reduce or otherwise modify power consumption by the load, the embodiment of FIG. 1 includes the power reduction module 120 and the harmonic reduction module 124. The power reduction module comprises any type of system or device capable or reducing the amount of power provided to the load when power is diverted, by the switching module 108, to travel through the power reduction module 120. In one embodiment the power reduction module comprises a step-down transformer. In another embodiment the power reduction module may comprise a transformer, motor controller contactors, resistor, timers, general duty delay, switches, and lights. It is further contemplated that the power reduction module may also comprise capacitors, resistors, variable capacitors, solid state contactors and trisistors. To overcome drawbacks of the prior art, the embodiment shown in FIG. 1 also includes a harmonic reduction module 124. The harmonic reduction module 124 performs signal processing on the output of the power reduction module 120 to provide an improved signal to the load 116. In one embodiment, the harmonic reduction module 124 comprises a pass filter having cut off frequency selected to remove unwanted harmonics or frequency components. In one embodiment the harmonic reduction module 124 comprises a capacitor sized to remove unwanted signal components. In some instances, failure to remove unwanted frequency components from the signal after power reduction may result in undesirable operation of the load. It is contemplated that the power reduction module 120 and the harmonic reduction module 124 may connect to ground or neutral 128 as necessary to achieve the aspects discussed herein.

In one embodiment, the input comprises a 60 hertz power signal and the load comprises high intensity discharge (HID) type lamps or fixtures. After an initial warm up phase, the power provided on the input 104 may be switched from directly going to the load to run through to the run through the power reduction module 120. Reduction of the voltage by the power reduction module 120 may introduce harmonics into the signal provided to the lamps, i.e. load 116. As a result of the harmonics, the level of power provided to the lamps may undesirably drop below the minimum required power level necessary to maintain operation of the load. This may cause the lamps to no longer illuminate and restoring the lamps to continued operation may require a complete reset of the system power to the lamp. Inclusion of the harmonic reduction module 124 resolves these issues and insures proper and reliable operation of the lamps.

Figure 2:
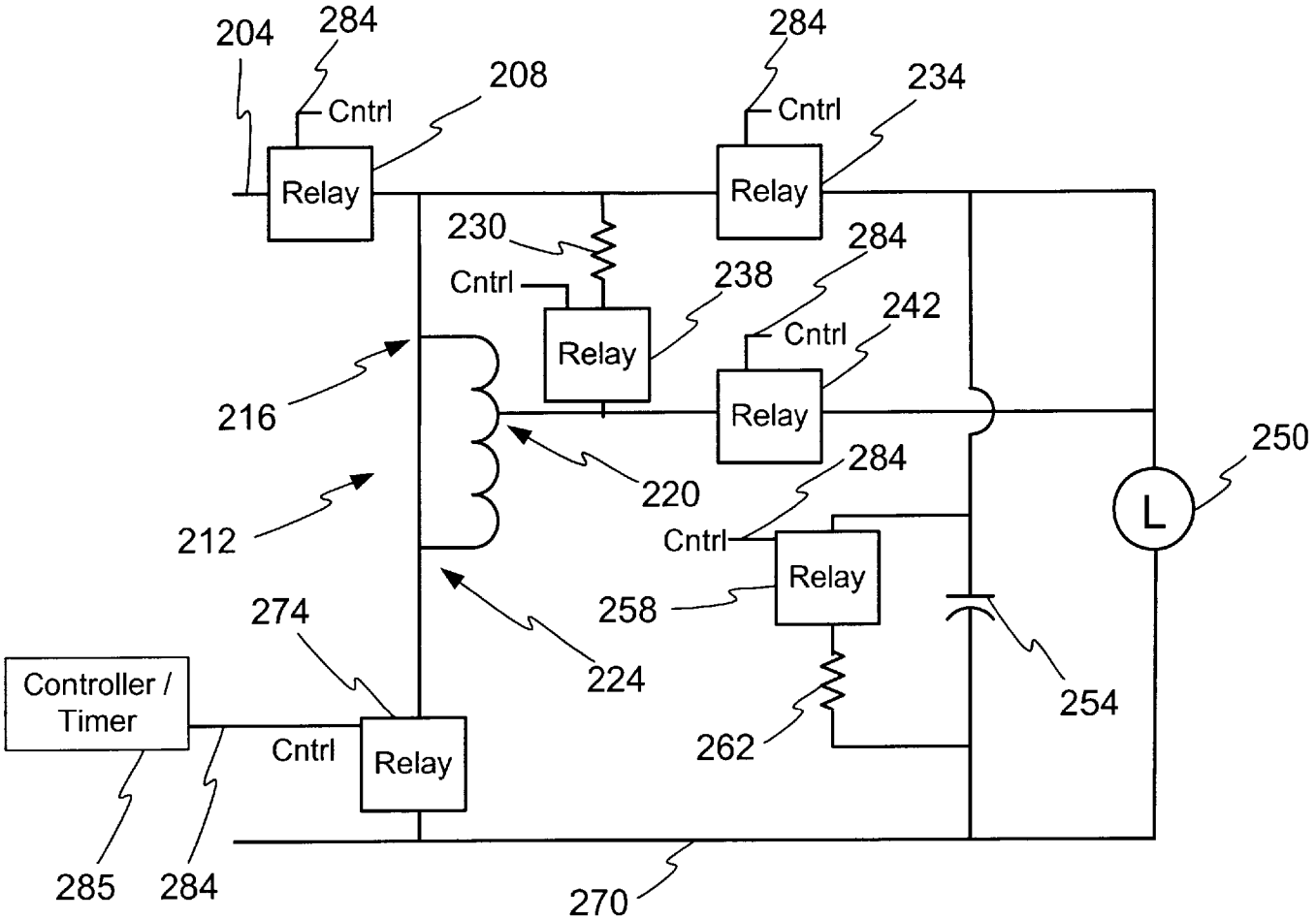
FIG. 2 illustrates a block diagram of one example embodiment of the power control system as shown in FIG. 1.

FIG. 2 illustrates a block diagram of one example embodiment of the power control system as shown in FIG. 1. As shown an input 204 connects to a first relay 208. The first relay 208 connects to a transformer 212, a resistor 230, and a second relay 234. The transformer 212 includes a first tap 216, a second tap 220 and a third tap 224. The output of the resistor 230 connects to a third relay 238, the output of which connects to the second tap 220 of the transformer 212 and the input to a fourth relay 242. The output of the second relay 234 and the fourth relay 242 connect to the load 250. The output of the second relay 234 also connects to a capacitor 254 which is located in parallel with a fifth relay 258 and a resistor 262 as shown. The load 250, capacitor 254, and resistor 262 connect to ground or neutral node 270. The third tap 224 of the transformer 212 connects to a sixth relay 274 which in turn connects to the ground or neutral node 270.

Each of the relays include a control signal input 284 which connects to a controller or timer 285. Any type controller or timer may be utilized in accordance with the teaching contained herein.

The relays 208, 234, 238, 242, 258, 274 are shown as relays for purposes of understanding. It is contemplated that devices other than relays may be utilized such as but not limited to switches, magnetic contacts, manual switches, resistors, trisistors, capacitors, fuse blocks, and phase monitors. The resistors 230 and 262 are selected based on the load 250 and the transformer 212. The second tap of the transformer 212 comprises a step down transformer tap configured to step down or reduce to voltage provided at the second tap 220 as compared to the voltage level at the input 204. By selective switching of the relays shown in FIG. 2, a reduced amount of voltage is provided to the load 250. Capacitor 254 is selected to provide supplemental power to the load 250 during the opening and closing of relays 234, 238, and 242. The capacitor 254 is further selected to pass unwanted frequencies, such as for example harmonics, to the ground or neutral node 270 and hence away from the load.

Figure 3:
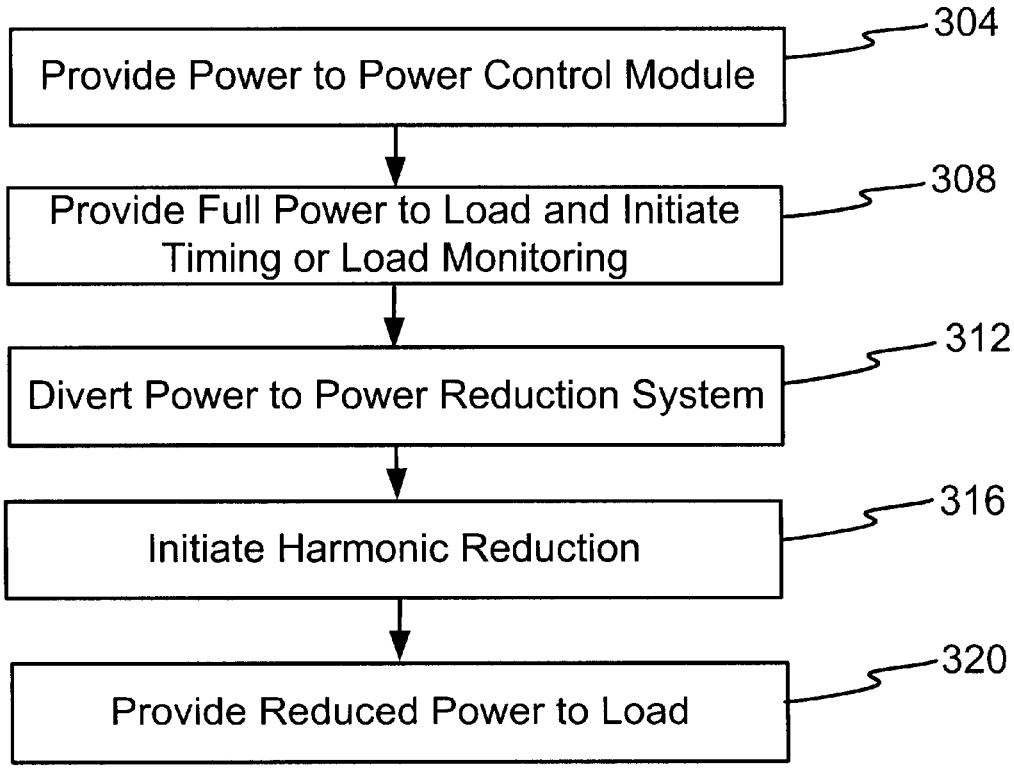
FIG. 3 illustrates an example method of operation of one embodiment of the method and apparatus described herein.

FIG. 3 illustrates an example method of operation of one embodiment of the method and apparatus described herein. At a step 304 the operation provides power to the power control module. This may occur by actuating a switch or relay. As an advantage of the invention, it may be desirable to locate a relay or switch between the power source and the transformer or other power control systems. As a result, power is not continually provided to these systems. In some configurations the transformer or other power control systems may draw power even when the load is not energized. Consequently, disconnecting the transformer or other power control systems from the power source during periods when the load is not in use may result in additional power savings. In the embodiment configured as shown in FIG. 2, a transform may consume 1% to 10% of the power consumed by the load.

Thereafter, at a step 308, the operation provides full power to the load to initiate desired operation of the load. It is contemplated that the load requires full power during an introductory start-up period and that after the introductory start-up period the power, i.e. voltage or current, supplied to the load may be reduced without significantly affecting operation of the load. Timing or monitoring of the load or some attribute of the load may occur during the period of step 308 to determine when operation power provided to the load may be reduced.

Next, at a step 312, the operation begins diverting power as provided directly to the load to a power reduction system and/or harmonic reduction module. This may occur rapidly or over a period of time to achieve a smooth transition that does not interfere with desired operation of the load. One or more circuits or power supply systems may be introduced to achieve a desired transition. At a step 316, the harmonic reduction operation occurs to reduce harmonics that may be created by the power reduction of step 312. In one embodiment, signal aspects other than harmonics are reduced or eliminated.

At a step 320, a reduced amount of power is provided to the load as compared to the amount or level of power provided at step 304. It is contemplated that the load continues to operate in a desired manner even at reduced power level and the load operates consistently as a result of the harmonic reduction or other signal improvement that occurs at step 316. This is but one possible method of operation that benefits from the harmonic reduction operation or other power signal modification methods discussed herein. It is contemplated that one of ordinary skill in the art may derive other methods of operation that do not depart from the scope of the invention.

Figure 4:
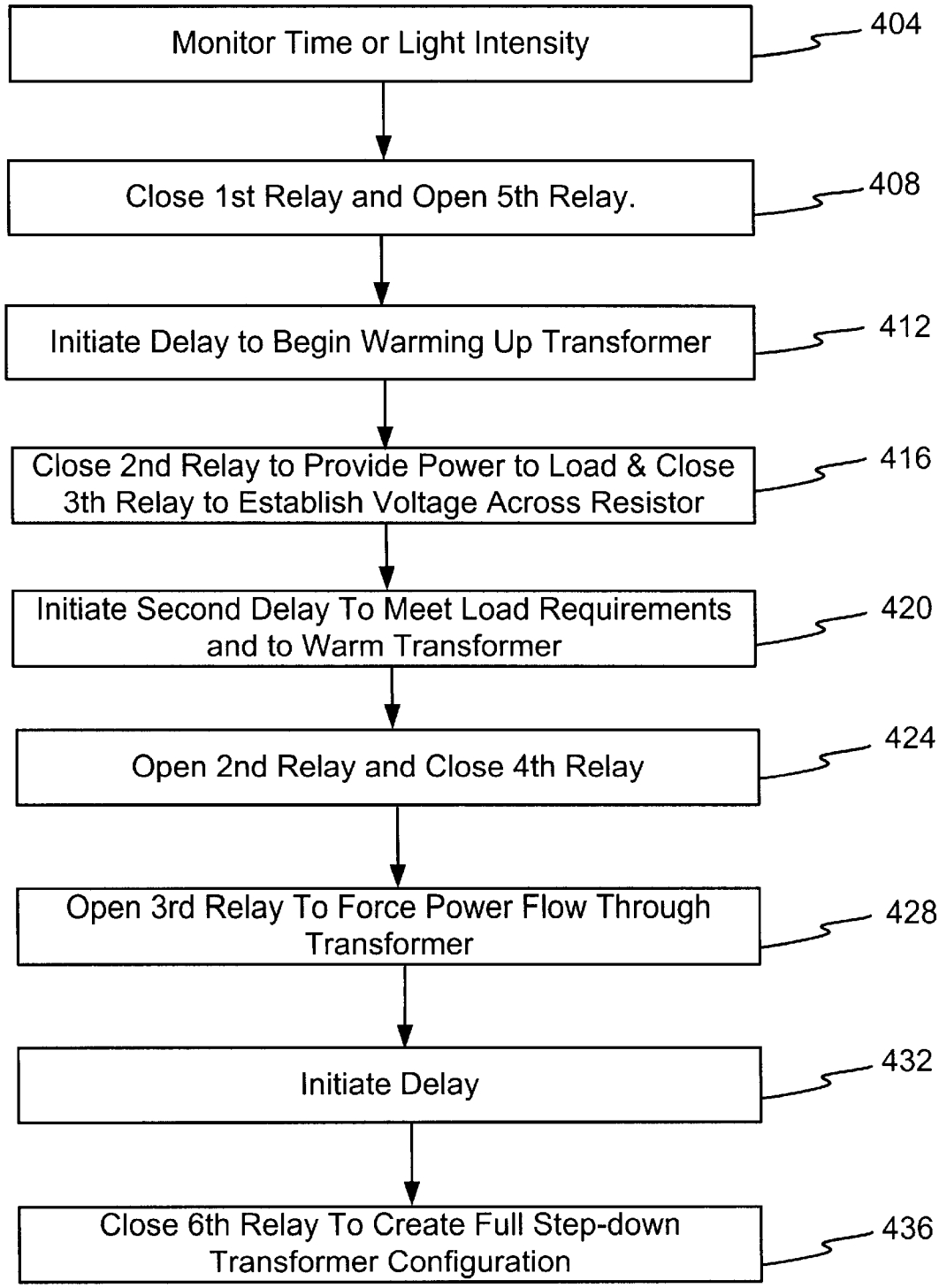
FIG. 4 illustrates an operational flow diagram of an alternative method of operation.

FIG. 4 illustrates an operational flow diagram of an alternative method of operation. For the method shown in FIG. 4, the discussion that follows closely tracks operation of the embodiment shown in FIG. 2. Accordingly the discussion of the method shown in FIG. 4 includes citation of the reference numeral of FIG. 2 to aid understanding. Prior to initiating the operation of the device shown in FIG. 2, it is contemplated that relays 208, 234, 238, 242, 274 are open while relay 258 is closed. The inhibits from power flowing through load 250 and transformer 212. Maintaining relay 258 in a closed position allows the charge of the capacitor 254 to dissipate to ground or neutral 270 via the resistor 262.

In reference to FIG. 4, at a step 404, the controller or timer 285 monitors, tracks or other determines a current time in relation to a predetermined time. The predetermined time may comprise a time at which a lighting system is to turn on. It is further contemplated that at step 404, the light intensity or brightness may be monitored, such as with a light monitor or detector, to determine when to energize a light system. The controller 285 may have a manual override. Upon the occurrence of the predetermined time, a detection of a light intensity value, such as approaching darkness, or a manual override command, the operation advances to step 408. At step 408, the controller closes the first relay 208 and opens the fifth relay 258. This energizes the transformer 212 and allows the capacitor 254 to fully charge by stopping current flow through the resistor 262.

Thereafter, at a step 412, the controller initiates a delay. The delay may be of any amount of time and is intended to begin warming up the transformer. In one embodiment the delay is based on the number of time units required to warm up the transformer 212. In one embodiment the delay is 5 time units. Any amount of delay may occur. Failure to properly warm the transformer may result in insufficient power supplied to the load. The amount of delay may depend on the amount of power drawn by the load and the transformer and the type of load. At a step 416, the operation closes the second relay 234 and closes the third relay 274. Closing the second relay 234 provides full power to the load. In some embodiments, the load requires full power during an initial time period so that during later stages of operation a reduced amount of power may be supplied to the load. Closing the third relay 274 establishes a voltage across the resistor 230 and thereby provides power to the second tap 220 of the transformer 212.

Next, at a step 420, a delay occurs to allow the load to continue operation for a period at full power. The duration of this delay is determined in large part by the type of load. For example, in one example configuration traditional HID type lamps require about 15 minutes to warm up while electronic HID type lamps require about 3 minutes to warm up. This delay further warms the transformer 212.

After the delay at step 420 the operation advances to step 424. At step 424, the controller opens the second relay 234 and closes the fourth relay 242. Opening the second relay 234 prevents direct power flow to the load while closing the fourth relay 242 causes current to flow to the load through the transformer. In one embodiment the time period between closing of the fourth relay 242 and opening the second relay 234 is a small amount of time. In one embodiment the time period is between 1 second and 0.0001 second. In another embodiment the time period is between 0.04 second and 0.001 second. It is desired to establish a rapid transition to insure sufficient power to the load. This prevents clipping of the lights which may result in a shut down. As a further advantage of the embodiment of FIG. 2, the capacitor 254 is charged prior to the transition of step 424 and is capable of providing discharge power to the load. In another embodiment solid state relays or thyristors may be provided to insure rapid switching.

Thereafter, at a step 428, the controller opens the third relay 238. This opens the bypass through the resistor 230. This directs the power drawn by the load to be provided by the second tap 220 of the transformer 212. At this point in time, relays 208, 242, and 274 are closed while the remaining relays are open. Next, at a step 432, the control introduces or initiates a delay. In one embodiment the delay is under 5 seconds. Various amounts of delay may occur to insure stable system operation. In one embodiment no delay is introduced before the actions of step 436.

At step 436 the controller closes the sixth relay 274. Closing the sixth relay establishes the transformer as a true step down transformer thereby allowing the full power savings of the configuration shown in FIG. 2 to be achieved. It should be noted that the transformer 212 may introduce harmonics in to the signal provided to the load. In one embodiment the third harmonic is particularly troublesome. Through inclusion of the capacitor 254 in parallel with the load 250 the method and apparatus herein shunts the unwanted signal components, such as the third harmonic, to ground or neutral 270. In one configuration the capacitor is selected to appear as a short circuit to the third and higher harmonics. Any frequency cut-off point may be achieved through selection of the appropriately sized capacitor. It is fully contemplated that devices other than a capacitor may be selected to remove the undesirable effects of harmonics or other signal components. To remove power to the load, the controller would close relays 208, 234, 238, 242, 274 while opening relay 258.

Figure 5:
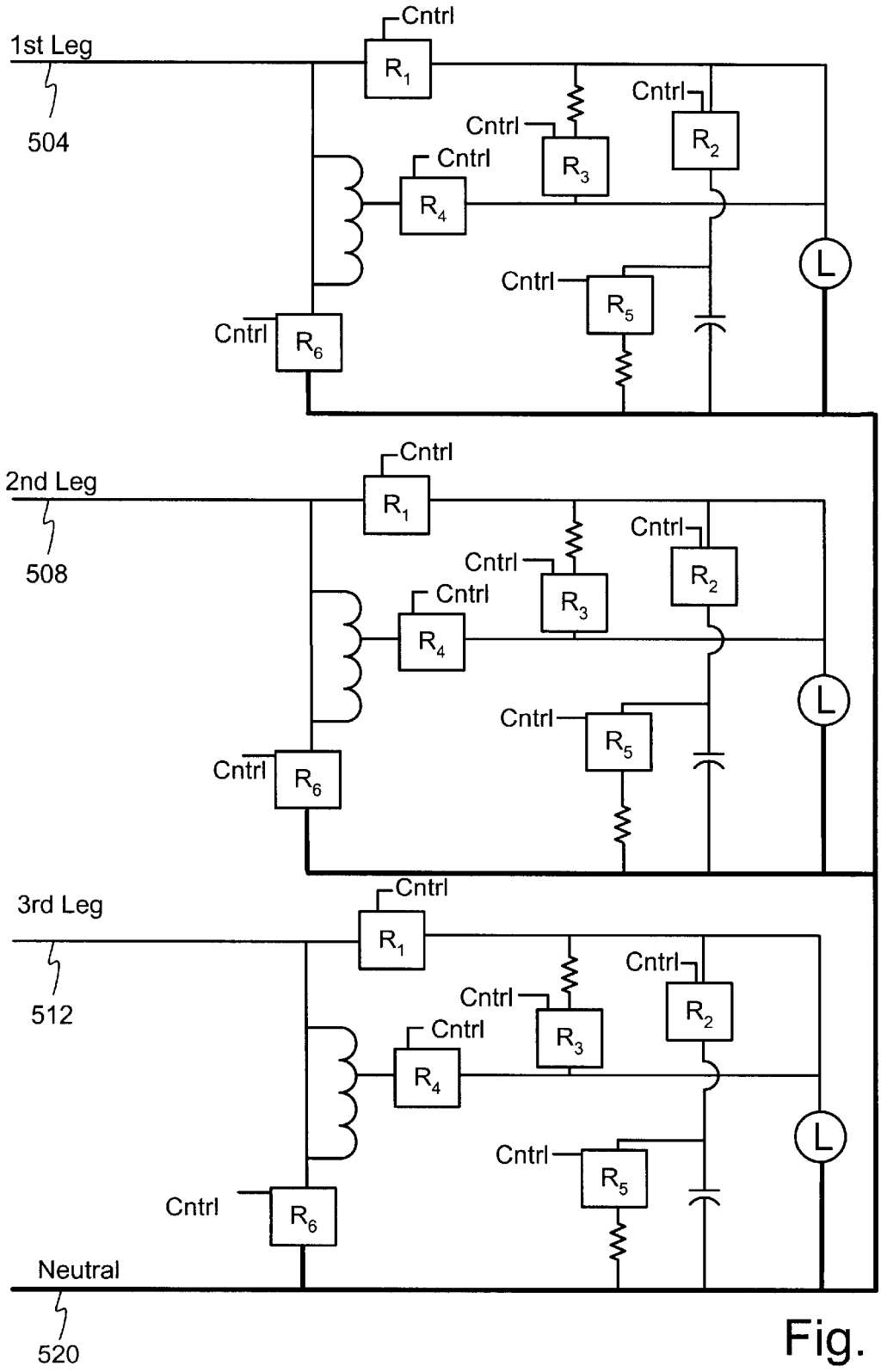
FIG. 5 illustrates an example embodiment of the embodiment shown in FIG. 2 assembled in a 3-phase configuration.

FIG. 5 illustrates an example embodiment of the embodiment shown in FIG. 2 assembled in a 3-phase configuration. The embodiment of FIG. 5 includes a first leg 504, a second leg 508, and a third leg 512. A neutral or ground 520 is shared by each power control system of the invention. Although shown in three power control systems, it is contemplated that a single power control system may control all three phases of a load. In one embodiment, the capacitor may be matched to the load and hence is not shared.

Figure 6:
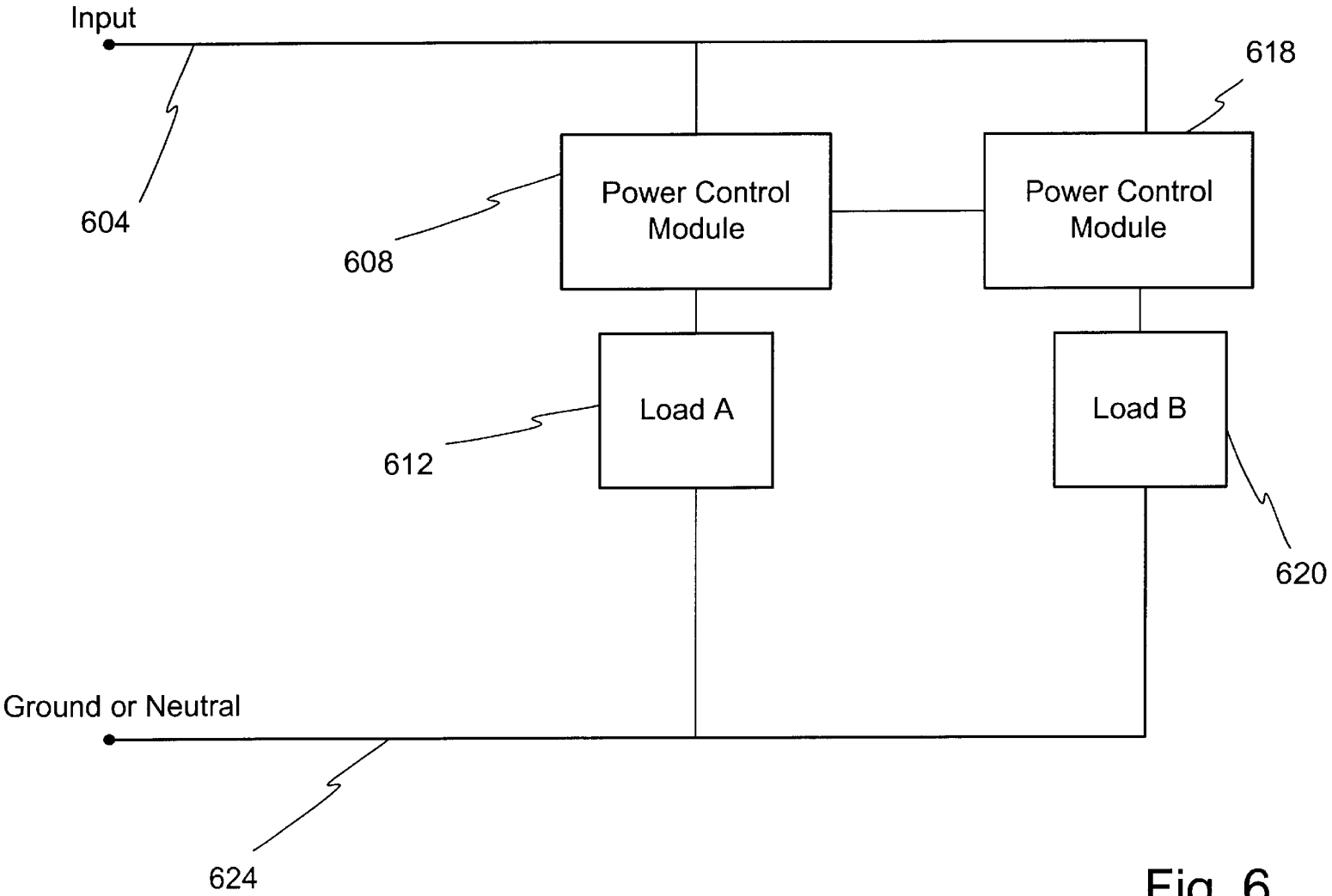
FIG. 6 illustrates a block diagram of an example embodiment of power control system incorporated with a stagger start system.

FIG. 6 illustrates a block diagram of an example embodiment of a staged start load utilizing a power control system. In some instances, it may be desirable to selectively engage or connect portions of a load to one or more of the power control modules described above. As shown in FIG. 6, an input 604 connects to a first power control module 608, the output of which connects to a load A 612. The input 604 also connects to a second power control module 616, which in turn connects to a load B 620. Load A 612 and load B 620 both connect to a ground or neutral leg 624. In one embodiment the power control modules 608, 616 connect or communication to exchange timing or switching information. The power control modules 608, 616 may comprise systems as described above. In one embodiment, the second power control module 616 is configured to delay providing power to the load B 620 for a period of time after the first power control module provides power to the load A 612. In one embodiment the load B 620 is only brought on line after the first power control module 608 has reduced the power provided to the load A 612. After the load A 612 is provided a reduced amount of power, then load B 620 is provided full power for a period sufficient to achieve desired operation of load B.

As an advantage to this configuration, the maximum power draw from the input 604 is reduced. By way of example, if both loads were brought on line at the same time there would be a peak draw of A+B during the initial start-up period when full power is provided to the loads by the first and second power control modules 608 and 616. In contrast, when load A 612 and load B 620 are stagger started, then during a first period the total load is A. Then during a second period, the load A 612 is reduced to 80% power draw and load B 620 is at 100% power draw. This is a total of 0.8A+B and is the maximum amount of power that will be draw by the loads. This reduces the peak power drawn by the load A and B 612, 620 and may allow a power user to qualify for reduced power pricing. It is contemplated that other configurations of splitting the load or staggered start may be implemented. In one embodiment a split bus configuration is adopted to reduce the total peak demand utilized by a load.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A power control system configured to control the amount of power provided to a load, the system comprising:

a timer configured to generate one or more control signals;

a step-down transformer comprising an input node and an output node, the output node connected to the load;

a switching system configured to selectively provide, responsive to the one or more control signals, power directly to the load or to the input of the step-down transformer;

a capacitor connected to the output node such that unwanted signal harmonics at the output node are not provided to the load;

wherein when the switching system provides power to the step-down transformer instead of directly to the load the amount of power provided to the load is reduced.

2. The system of claim 1, wherein the one or more control signals generated by the timer cause the switching system to provide power directly to the load during a first period and to the step-down transformer during a second period, wherein the second period is subsequent to the first period.

3. The system of claim 1, wherein the capacitor comprises a capacitor selected to provide the third harmonic to ground.

4. The system of claim 1, wherein the switching system comprises one or more relays.

5. The system of claim 1, wherein the load comprises lamps selected from the group consisting of metal halide lamps, high pressure sodium lamps, and mercury vapor lamps.

6. A system for reducing the amount of power consumed by a lighting system, the system comprising:

an input configured to connect to a source of power;

a controller configured to generate one or more control signals;

a voltage control system configured to reduce the amount of voltage provided to the lighting system;

a filter configured to filter unwanted signal components from the voltage provided to the lighting system one or more relays, responsive to the one or more control signals, configured to selectively activate the voltage control system to thereby reduce the amount of voltage provided to the lighting system;

wherein the controller does not activate the voltage control system until after the lighting system operates at full power for a time sufficient to sustain operation the lighting system at the reduced amount of voltage.

7. The system of claim 6, wherein the voltage control system comprises a transformer.

8. The system of claim 6, further including a timer or a sensor configured to control activation of the system for reducing the amount of power consumed by a lighting system.

9. The system of claim 6, wherein the controller comprises a timer and a signal generator.

10. The system of claim 6, wherein the filter comprises a capacitor.

11. A method for controlling the power provided to a load to reduce power consumption of the load, the method comprising:

closing a load relay to provide power to a load;

closing a transformer relay to provide power to a step-down transformer, the step-down transformer having a stepped down output connected to a step down relay, wherein the step down relay also connects to a first node, such that the first node serves as a connection point for the load and a capacitor, the capacitor selected to shunt unwanted signal components to ground;

opening the load relay while closing the step down relay, wherein the step down relay selectively controls power flow from the stepped down output to the first node;

wherein the opening the load relay and the closing the step down relay occurs after the step-down transformer and load have reached full operating capacity.

12. The method of claim 11, wherein the load comprises a plurality of lamps.

13. The method of claim 11, wherein the capacitor is selected to conduct harmonics created by the step-down transformer away from the load.

14. The method of claim 11, wherein the unwanted signal components comprise signal components having frequencies at or above the third harmonic.

15. A method for reducing power consumption of a lighting system comprising:

providing a signal at a first voltage to the lighting system during a start-up period, activating a voltage reduction module, the voltage reduction module creating signal having a second voltage, wherein the second voltage is smaller than the first voltage;

processing the signal having a second voltage to remove unwanted frequency components of the signal having a second voltage; and providing the signal having a second voltage to the lighting system after the start-up period.

16. The method of claim 15, wherein the start-up period comprises a period of time during which the lighting system operates at full power.

17. The method of claim 15, wherein the lighting system comprises gas discharge lamps.

18. The method of claim 15, wherein processing comprises providing the signal to a node to which a capacitor is connected to thereby remove signal harmonics.

19. The method of claim 15, wherein the signal at the first voltage consists of a signal at a voltage selected from the group of 120, 208, 277, 240, and 480 volts.

20. The method of claim 15, wherein the second voltage comprises 80% of the first voltage.

* * * * *